US010932592B2

(12) United States Patent
Godbole

(10) Patent No.: US 10,932,592 B2
(45) Date of Patent: Mar. 2, 2021

(54) INDEXING COOLER

(71) Applicant: The Coca-Cola Company, Atlanta, GA (US)

(72) Inventor: Vinayak Godbole, Peachtree City, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 16/080,335

(22) PCT Filed: Feb. 15, 2017

(86) PCT No.: PCT/US2017/017891

§ 371 (c)(1),
(2) Date: Aug. 28, 2018

(87) PCT Pub. No.: WO2017/151316

PCT Pub. Date: Sep. 8, 2017

(65) Prior Publication Data

US 2019/0069693 A1 Mar. 7, 2019

Related U.S. Application Data

(60) Provisional application No. 62/301,650, filed on Mar. 1, 2016.

(51) Int. Cl.

| | |
|---|---|
| ***A47F 3/04*** | (2006.01) |
| ***F25D 25/02*** | (2006.01) |
| ***A47F 3/11*** | (2006.01) |

(52) U.S. Cl.

CPC ..... *A47F 3/0439* (2013.01); *A47F 3/11* (2013.01); *F25D 25/027* (2013.01); *A47F 3/0452* (2013.01); *A47F 2003/0473* (2013.01)

(58) Field of Classification Search

CPC .... A47F 3/0404; A47F 3/0439; A47F 3/0486; A47F 3/06; A47F 3/08; A47F 3/10; A47F 3/11; A47F 5/0087; F25D 25/027

See application file for complete search history.

(56) References Cited

U.S. PATENT DOCUMENTS 2,565,079 A * 8/1951 Kern ..... A47F 3/08 362/125
2,811,403 A * 10/1957 Barker ..... A47F 3/08 194/240

(Continued)

FOREIGN PATENT DOCUMENTS

DE 2351714 A1 * 4/1975 ..... F25D 23/10
EP 0 606 193 A1 7/1994

(Continued)

OTHER PUBLICATIONS

International Search Report and Written Opinion, PCT/US2017/017891, dated May 12, 2017 (16 pp.).

(Continued)

*Primary Examiner* — Andrew M Roersma
(74) *Attorney, Agent, or Firm* — Eversheds Sutherland (US) LLP

(57) ABSTRACT

The present application provides an indexing cooler for a number of products. The indexing cooler may include an outer shell, a number of rotating product zones, and an indexing drive motor. The indexing drive motor rotates one of the rotating product zones into an exposed zone for a first predetermined length of a time.

13 Claims, 17 Drawing Sheets

(56) References Cited

U.S. PATENT DOCUMENTS

| | | | | |
|---|---|---|---|---|
| 3,216,775 | A * | 11/1965 | Brenner | F25D 25/027 108/20 |
| 7,152,423 | B2 * | 12/2006 | Schmitz | A47F 3/0408 62/250 |
| 7,259,359 | B2 * | 8/2007 | Davey | A47F 3/0404 219/218 |
| 2010/0205991 | A1 * | 8/2010 | Ernst | A47F 3/0469 62/246 |
| 2010/0242514 | A1 * | 9/2010 | Ramos De La Fuente | A47F 3/0404 62/255 |
| 2010/0314976 | A1 | 12/2010 | Gardner et al. | |
| 2014/0132128 | A1 | 5/2014 | Simon | |
| 2014/0300266 | A1 | 10/2014 | Rindlisbach et al. | |

FOREIGN PATENT DOCUMENTS

| | | | | |
|---|---|---|---|---|
| EP | 1076213 | A2 * | 2/2001 | A47F 3/0408 |
| FR | 840383 | A * | 4/1939 | A47F 3/08 |
| WO | 00 01281 | A1 | 1/2000 | |

OTHER PUBLICATIONS

EP Intent to Grant, EP 17 760 471.1-1011, dated Apr. 15, 2020 (6 pp.).

* cited by examiner

INDEXING COOLER

TECHNICAL FIELD

The present application and the resultant patent relate generally to merchandising coolers and other types of product dispensers and more particularly relate to an indexing cooler with the features of an open front cooler and/or a supercooling cooler but with the increased energy efficiency of a glass door merchandiser.

BACKGROUND OF THE INVENTION

Generally described, an open front cooler includes an open refrigerated space with a number of chilled products therein within the reach of a consumer. Because of this quick and easy accessibility and proximity to the chilled products therein, open front coolers often spur impulse purchases from consumers who prefer chilled products as compared to those at ambient temperatures. As a result, open front coolers generally provide an increased sales volume over conventional glass door merchandisers and the like of the same size and/or in similar locations and/or with products stored at ambient temperatures.

One drawback with conventional open front coolers, however, is that the coolers may consume several more times energy than a glass door merchandiser of the same size due to the lack of a door or other type of insulated front space. The increase sales volume generally provided by an open front cooler thus may not cover or justify the increased energy cost.

Likewise, supercooling coolers are increasingly popular. Supercooling coolers may cool a beverage below freezing such that ice crystals may form after the container holding the beverage is opened or energy is otherwise imparted to the beverage to initiate nucleation of the ice crystals. In order for such supercooling techniques to work properly, however, all of the beverages within the cooler must remain within a narrow temperature band at all times.

There is thus a desire for an improved open front cooler, a supercooling cooler, or other type of merchandiser. Such coolers may promote impulse purchases with easy accessibility but with the reduced energy costs of a typical glass door merchandiser and the like.

SUMMARY OF THE INVENTION

The present application and the resultant patent provide an indexing cooler for a number of products. The indexing cooler may include an outer shell, a number of rotating product zones, and an indexing drive motor. The indexing drive motor rotates one of the rotating product zones into an exposed zone for a first predetermined length of a time.

The present application and the resultant patent further describe a method of providing a product. The method may include the steps of providing a number of the products in each of a number of product zones, indexing a first one of the product zones about an open front or a door of a cooler, indexing the remaining products zones into a refrigerated product chamber, and indexing a second one of the product zones about the open front or a door of the cooler after a predetermined amount of time.

The present application and the resulting patent further provide an indexing cooler for a number of products. The indexing cooler may include an insulated outer shell, a number of indexing wings defining a number of product zones, and an indexing drive motor for rotating the indexing wings. The indexing drive motor rotates one of the product zones into an exposed zone for a predetermined length of a time.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
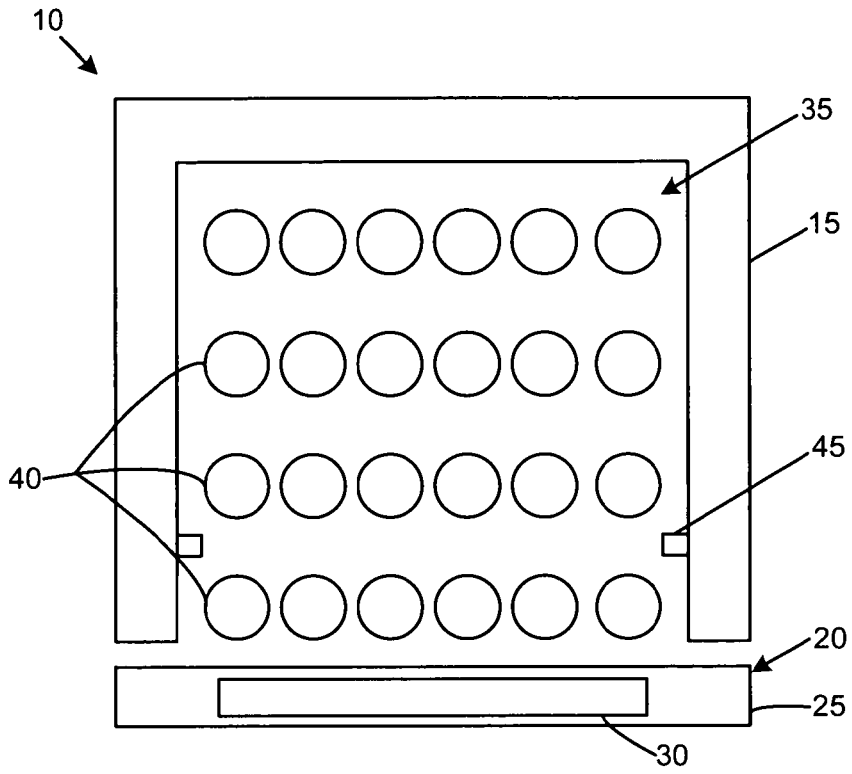
FIG. 1 is a schematic diagram of a portion of a known glass door merchandiser.

Referring now to the drawings, in which like numerals refer to like elements throughout the several views, FIG. 1 shows an example of a known glass door merchandiser 10. The glass door merchandiser 10 may include an outer shell 15. The outer shell 15 may be insulated in a conventional manner. The outer shell 15 may be enclosed by a door 20. The door 20 may include a frame 25 and a transparent panel 30. The glass door merchandiser 10 may include any number of shelves 35. The shelves 35 may hold any number of products 40 thereon. The products 40 may include any type or size of container including, but not limited to, bottles, cans, pouches, boxes, wrapped items, and/or any type of rigid or flexible packaging. The products 40 may include beverages, food items, non-food items, consumer products, and/or any type of product 40 that may be positioned on a shelf and/or that may be vended. The scope of this application and the resultant patent is not limited by the nature of the products 40 intended to be used herein. Similarly, while one use herein is for a chilled product 40, it will be understood that the product 40 herein may be at ambient temperatures, refrigerated, frozen, heated, or at any desired temperature or state. The products 40 may be illuminated by any number or type of lights 45.

Figure 2:
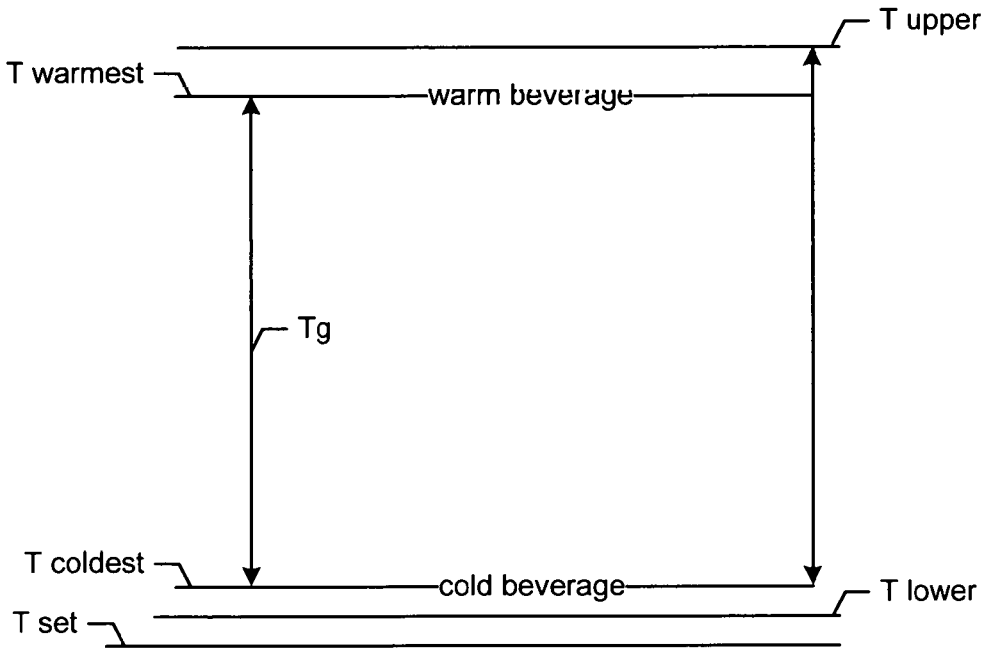
FIG. 2 is a cooling diagram for the glass door merchandiser of FIG. 1.
Figure 3:
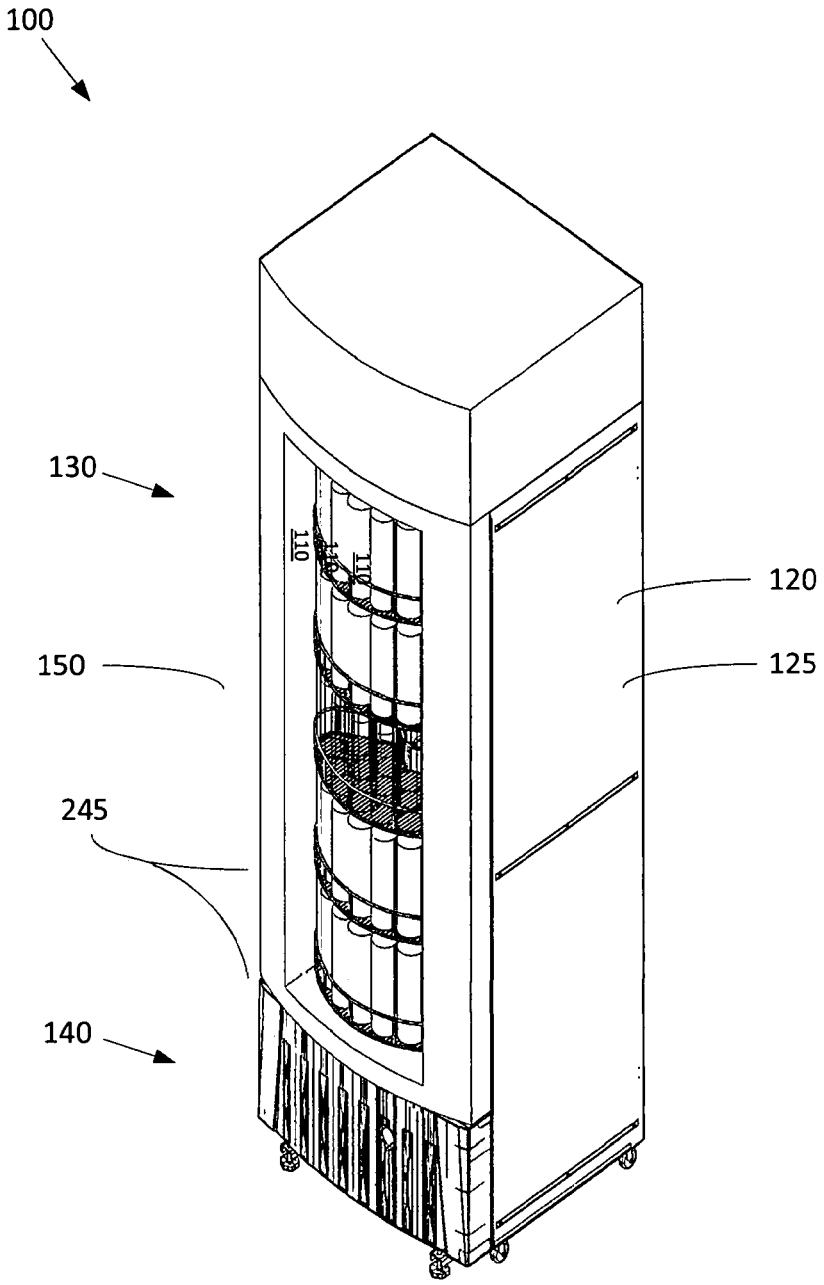
FIG. 3 is perspective view of an indexing cooler as may be described herein.
Figure 4:
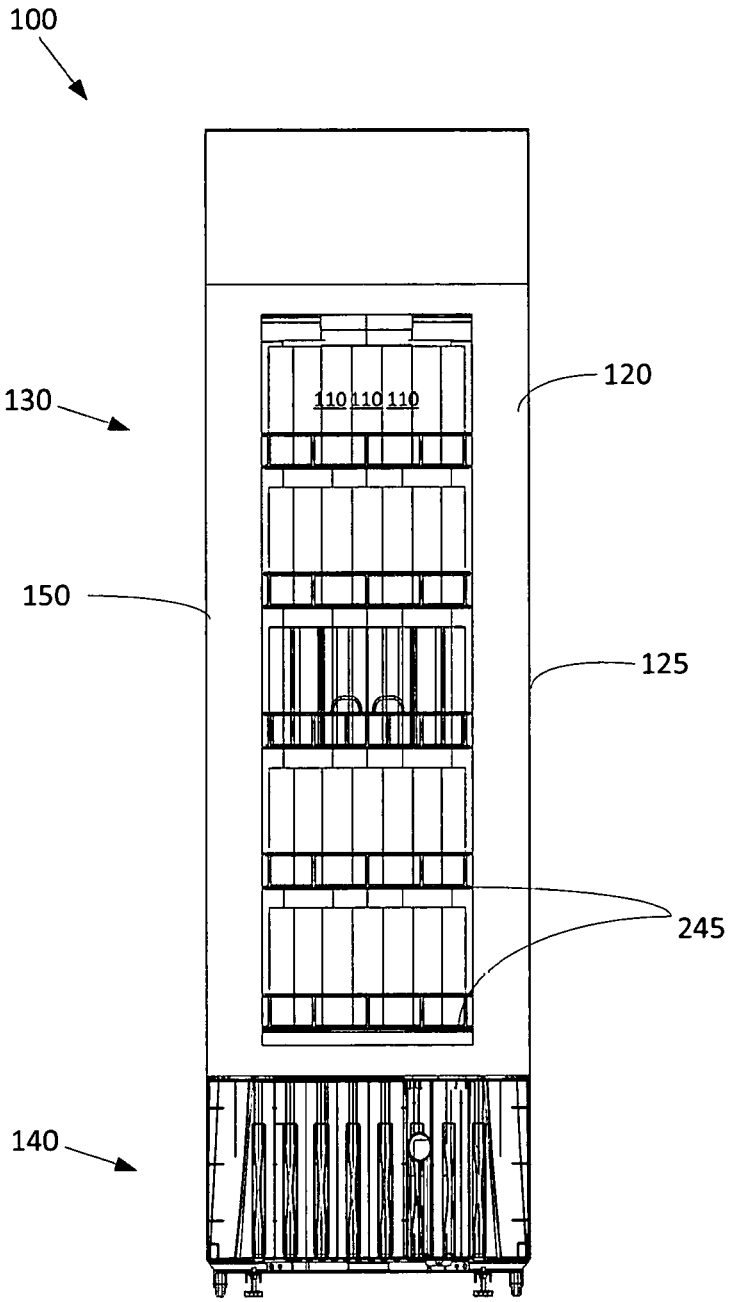
FIG. 4 is a front plan view of the indexing cooler of FIG. 3.

The configuration of the typical glass door merchandiser 10 may lead to the development of a number of thermal gradients therein. For example, the front rows of the shelves 35 may be warmer than the back rows due to radiation heat transfer through the glass panel 30 of the door 20, the lights 45, and less insulation. Likewise, the cooling air flow may warm as it rises through the glass door merchandiser 10. FIG. 2 is a cooling diagram that shows a temperature gradient Tg from Tcoldest about the bottom of the merchandiser 10 to Twarmest about the top of the merchandiser. Both Tcoldest and Twarmest may be between a lower specification limit Tl and an upper specification limit Tu. In order to accommodate this gradient Tg, the merchandiser 10 may be set at a set point Tset that may be slightly below the lower specification limit Tl. The merchandiser 10 thus may operate against ambient temperatures with the low set point Tset.

FIGS. 3-7 show an example of an indexing cooler 100 as may be described herein. The indexing cooler 100 may have any number of products 110 therein. The indexing cooler 100 may include an outer shell 120. In this example, the outer shell 120 may have a substantially rectangular configuration 125, but the outer shell 120 may have any suitable size, shape, or configuration. The outer shell 120 may be made out of metals, plastics, or any suitable rigid material. The outer shell 120 may be insulated in whole or in part. The outer shell 120 may define a product area 130 and a refrigeration component area 140. The refrigeration component area 140 may include conventional refrigeration and/or heating components and the like therein. The outer shell 120 may include an open front 150. The open front 150 may have any suitable size, shape, or configuration. Other components and other configurations also may be used herein.

Figure 5:
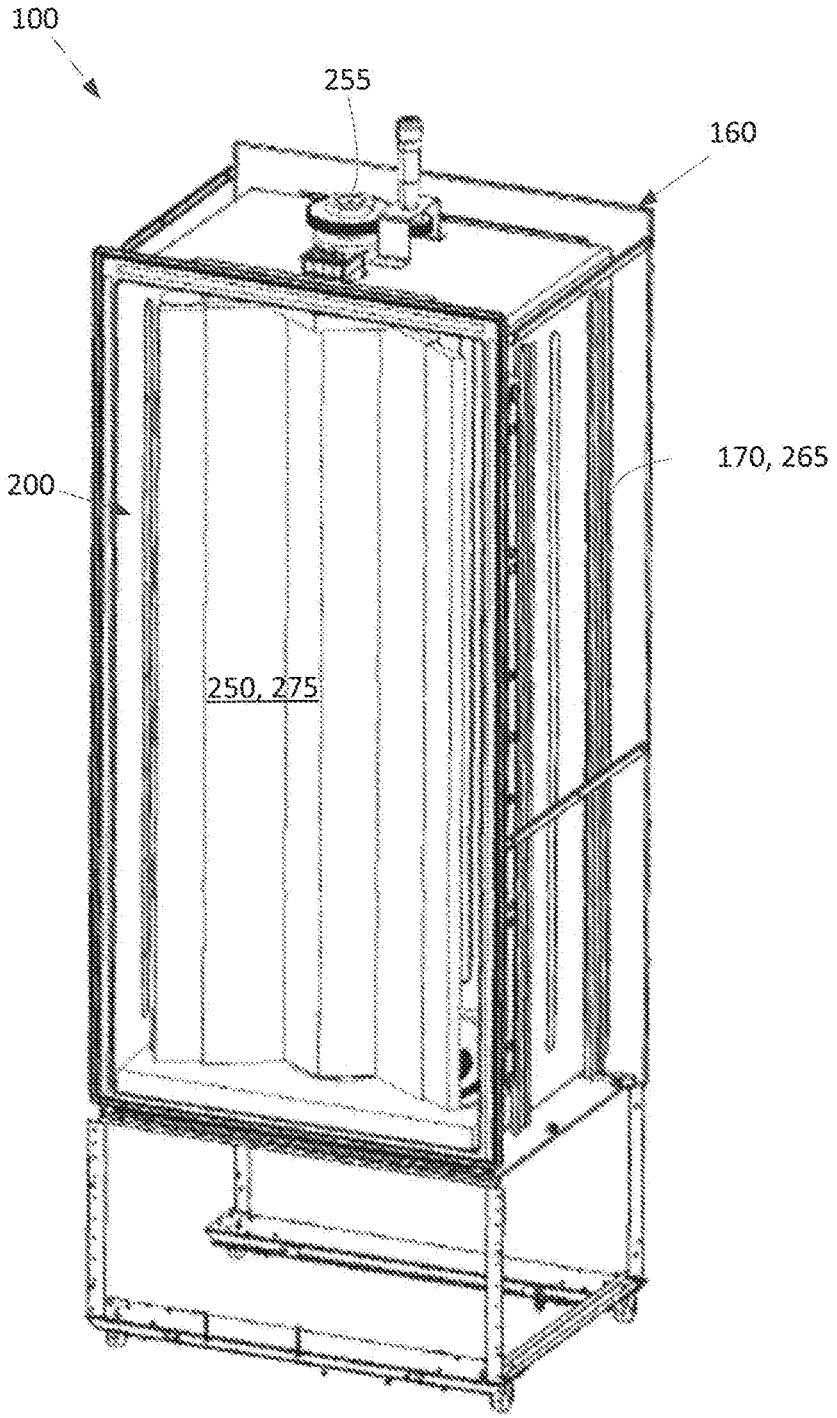
FIG. 5 is a perspective view of the indexing cooler of FIG. 3 with the outer shell removed.
Figure 6:
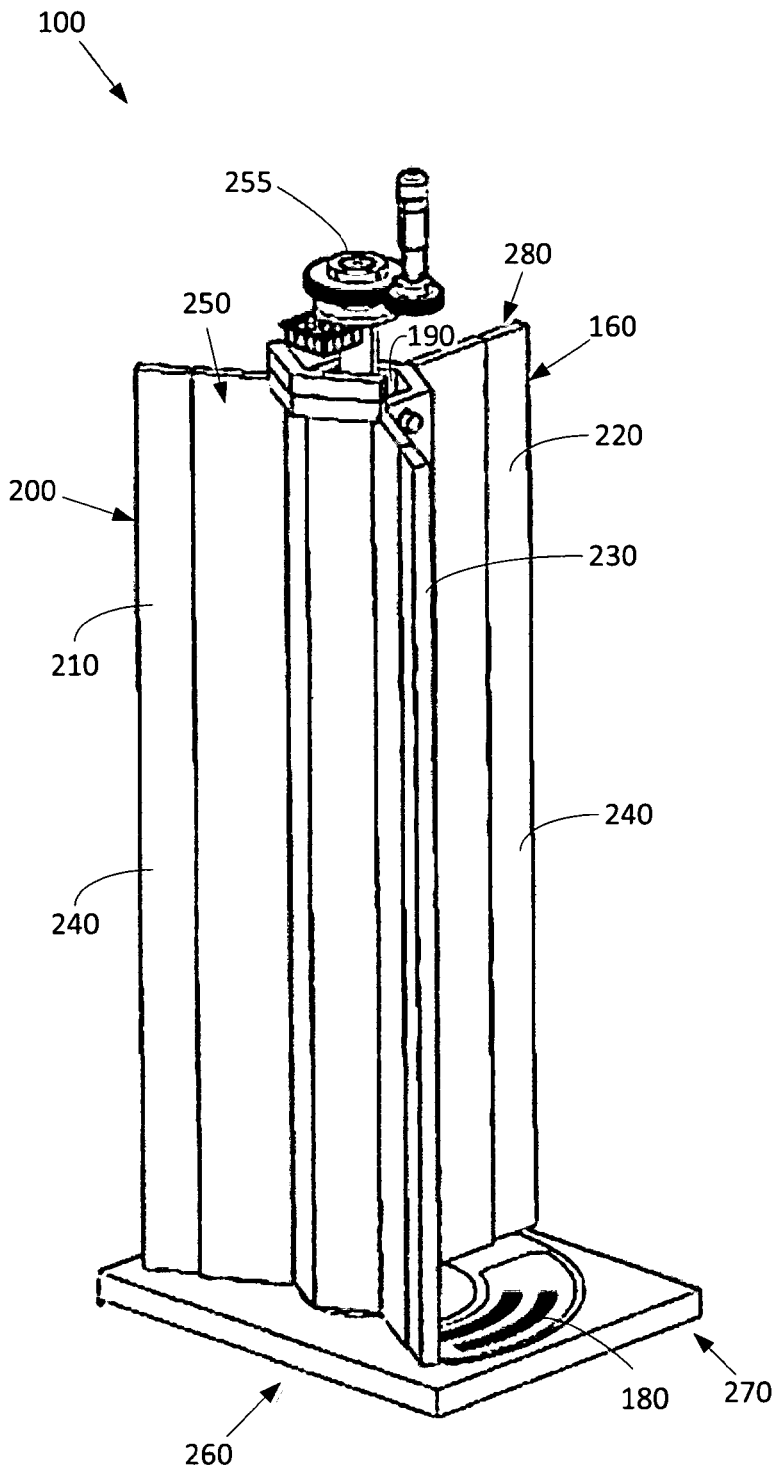
FIG. 6 is a perspective view of the indexing system of the indexing cooler of FIG. 3.
Figure 7:
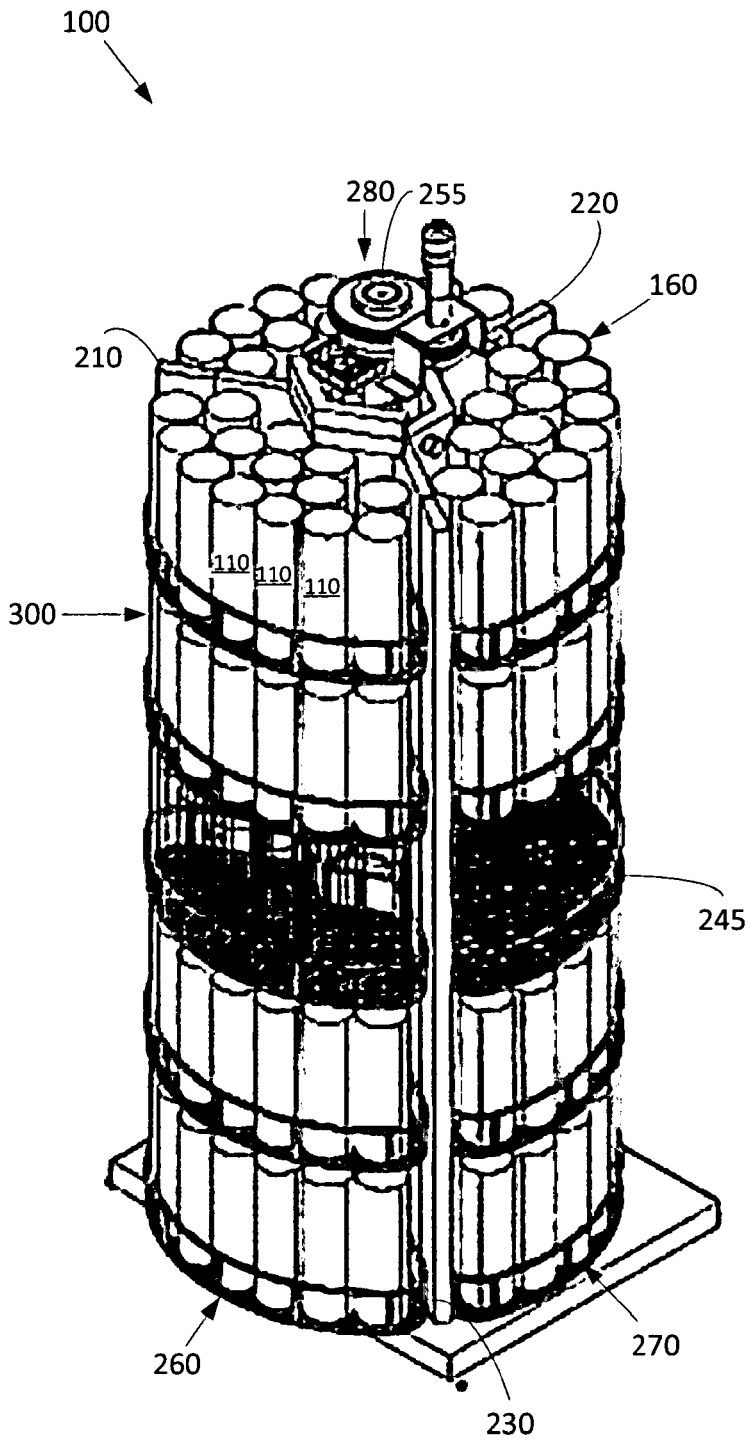
FIG. 7 is a further perspective view of the indexing system of the indexing cooler of FIG. 3.

FIGS. 5-7 show an example of an indexing system 160 that may be used within the indexing cooler 100. The indexing system 160 may include a product chamber 170 positioned within the product area 130 of the outer shell 120. The product chamber 170 may have any suitable size, shape, or configuration and may be made of out of metals, plastics, or any suitable rigid material. The product chamber 170 may be insulated. The product chamber 170 may be open on the side adjacent to the open front 150 of the outer shell 120. The product chamber 170 may be in communication with the refrigeration component area 140 via a number of incoming air vents 180 and one or more outgoing air plenums 190. The air vents 180 and the air plenums 190 may have any suitable size, shape, or configuration. Cold, refrigerated air may flow through the air vents 180 to cool the products 110 therein and then return to the refrigeration component area 140 via the air plenum 190. Other components and other configurations may be used herein.

The indexing system 160 may operate in a manner similar to a revolving door. The indexing system 160 thus may include a number of indexing wings 200 that may rotate within the product chamber 170. In this example, three indexing wings 200 are shown, a first indexing wing 210, a second indexing wing 220, and a third indexing wing 230. Any number of the indexing wings 200 may be used herein. The indexing wings 200 may have any suitable size, shape, or configuration. The indexing wings 200 may extend from and may rotate about the air plenum 190 at one end thereof. The indexing wings 200 may have a brush seal 240 and the like at the far end thereof. The brush seals 240 ensure that the cooler air does not escape from the product chamber 170 into the open front 150. Other types of mechanical seals may be used herein. A number of product shelves 245 and the like may be positioned on each of the indexing wings 200. The product shelves 245 may have any suitable size, shape, or configuration. The indexing wings 200 may rotate via an indexing drive motor 255. The indexing drive motor 255 may be any type of conventional drive device. Other components and other configurations may be used herein.

The indexing wings 200 may divide the product chamber 170 into three product zones 250, a first product zone 260, a second product zone 270, and a third product zone 280. Any number of the products zones 250 may be used herein. The product zones 250 may have any suitable size, shape, or configuration. In this example, at any given time, one of the product zones 250 will be an exposed zone 275 adjacent to the open front 150 while the other two product zones 250 will be refrigerated zones 265 in communication with the refrigerated component area 140. As is shown in FIG. 7, this example of the indexing system 160 may have a substantially round configuration 300. As a result of the round configuration 300, each of the product zones 250 may take up approximately one-third of a round, pie-like shape. As will be described in more detail below, other shapes and configurations may be used herein.

In use, any number of the products 110 may be loaded into each of the product shelves 245 in the product zones 250. The indexing system 160 may rotate at any predetermined interval. For example, the indexing system may index one product zone 250 into to the exposed zone 275 by the open front 150 approximately every 30 seconds or so. Any other period of time may be used. Specifically, one of the product zones 250 will be in the exposed zone 275 adjacent to the open front 150 of the outer shell 120 and thus exposed to ambient temperatures. The remaining product zones 250, however, will remain within the refrigerated zones 265 of the product chamber 170 and thus in the refrigerated space. For example, the first product zone 260 may be adjacent to the open front 150 for about 30 seconds or any given amount of time. The products 110 therein thus are easily accessible by consumers in the manner of a typical open front cooler. The second product zone 270 and the third product zone 280, however, remain within the product chamber 170 and hence refrigerated for about 60 seconds such that the ratio of ambient to refrigerated is about 1:2. Other ratios may be used herein. The indexing cooler 100 may have proximity sensors and the like that prevent rotation when a consumer approaches so as to given the consumer a sufficient amount of time to make a selection.

The indexing cooler 100 also may incorporate lighting and/or sound. In other words, the indexing cooler 100 may employ lighting, graphics, sound, and the like when rotating or otherwise. In addition to the impulse purchases often provided by an open front cooler, the motion of the rotating product zones 250 also may serve to attract a consumer's attention.

The indexing cooler 100 thus provides the benefits of a conventional open front cooler with the energy savings generally associated with a closed glass door merchandiser. Moreover, the use of the multiple product zones 250 allows the indexing cooler 100 to provide and promote more types of different brands than is typically possible in a stationary cooler. Other components and other configurations may be used herein.

Figure 8:
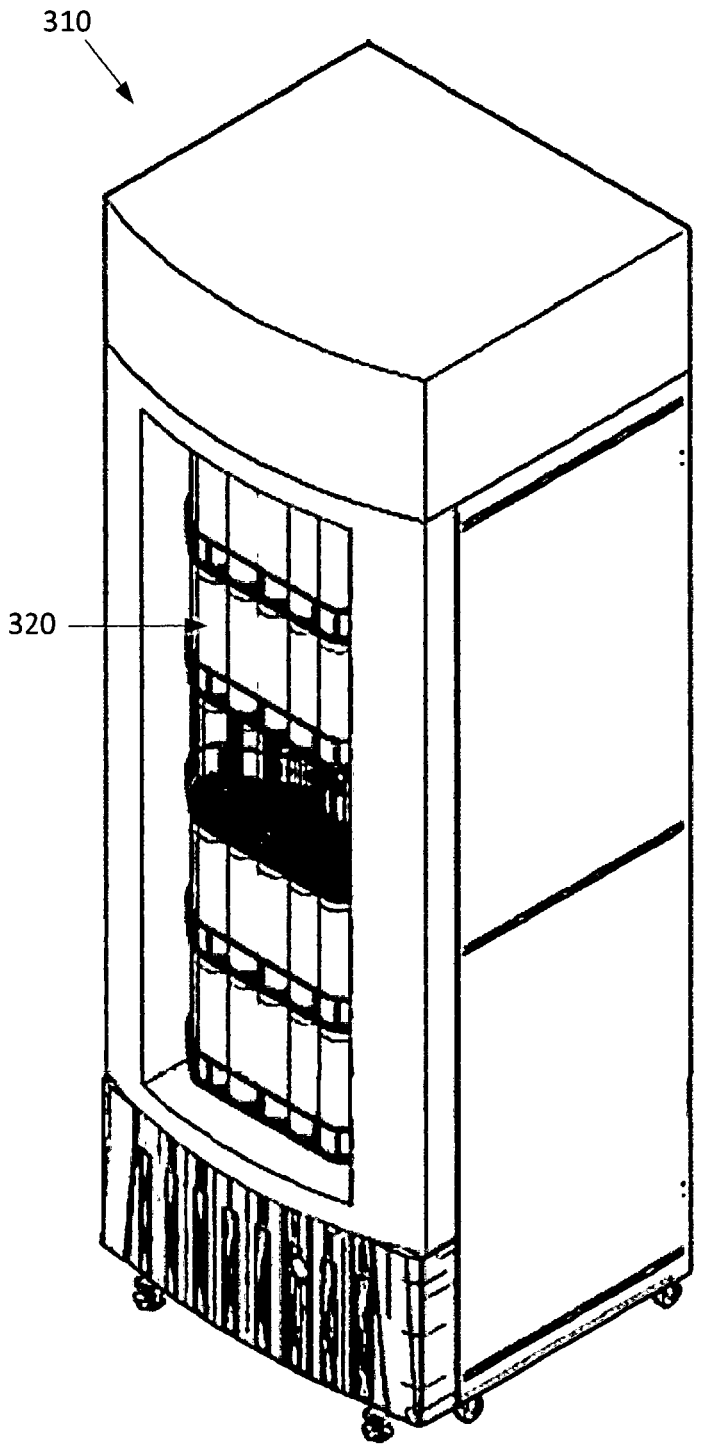
FIG. 8 is a perspective view of an alternative embodiment of an indexing cooler as may be described herein.
Figure 9:
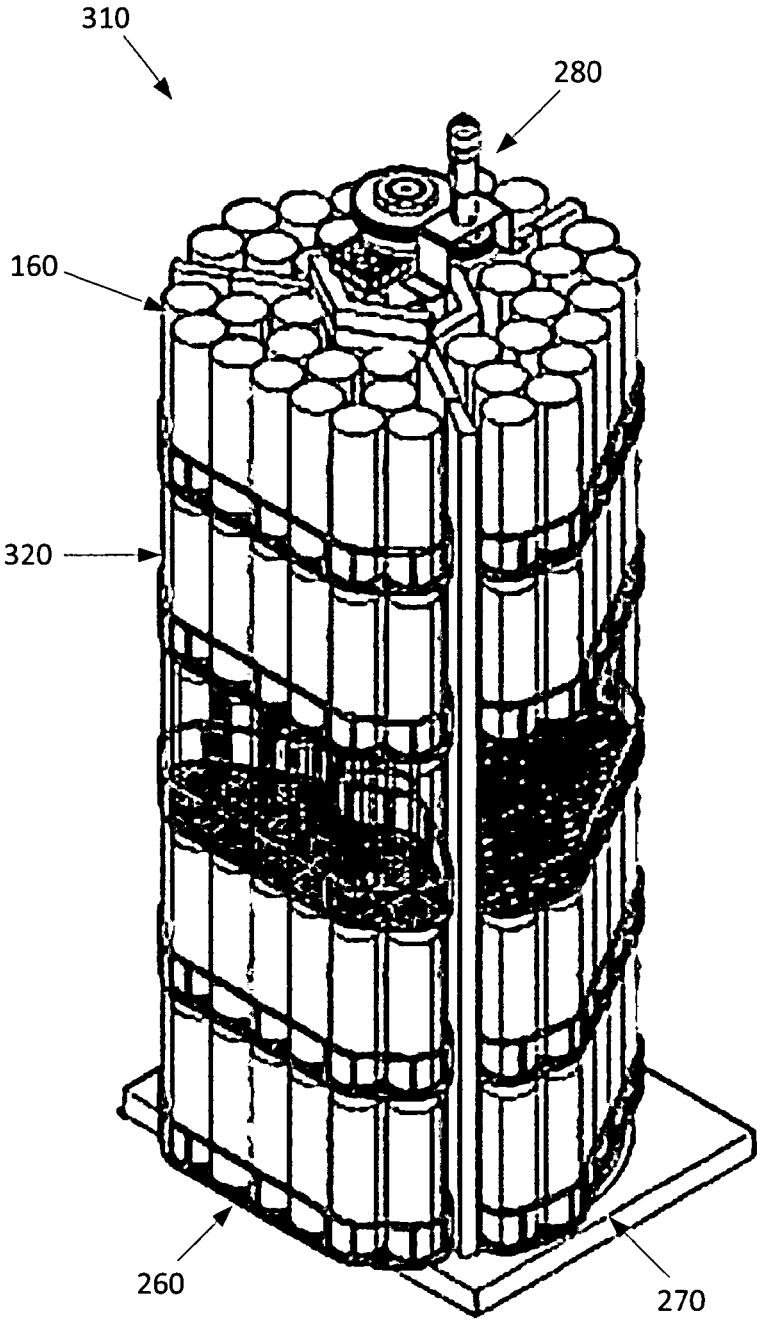
FIG. 9 is a perspective view of the indexing system of the indexing cooler of FIG. 8.

FIGS. 8 and 9 show and alternative embodiment of an indexing cooler 310 as may be described herein. The indexing cooler 310 may be largely similar to that described above. In this embodiment, the indexing system 160 may include a flat configuration 320. The three product zones 250 thus combine to form a largely triangular shape. Other components and other configurations may be used herein.

Figure 10:
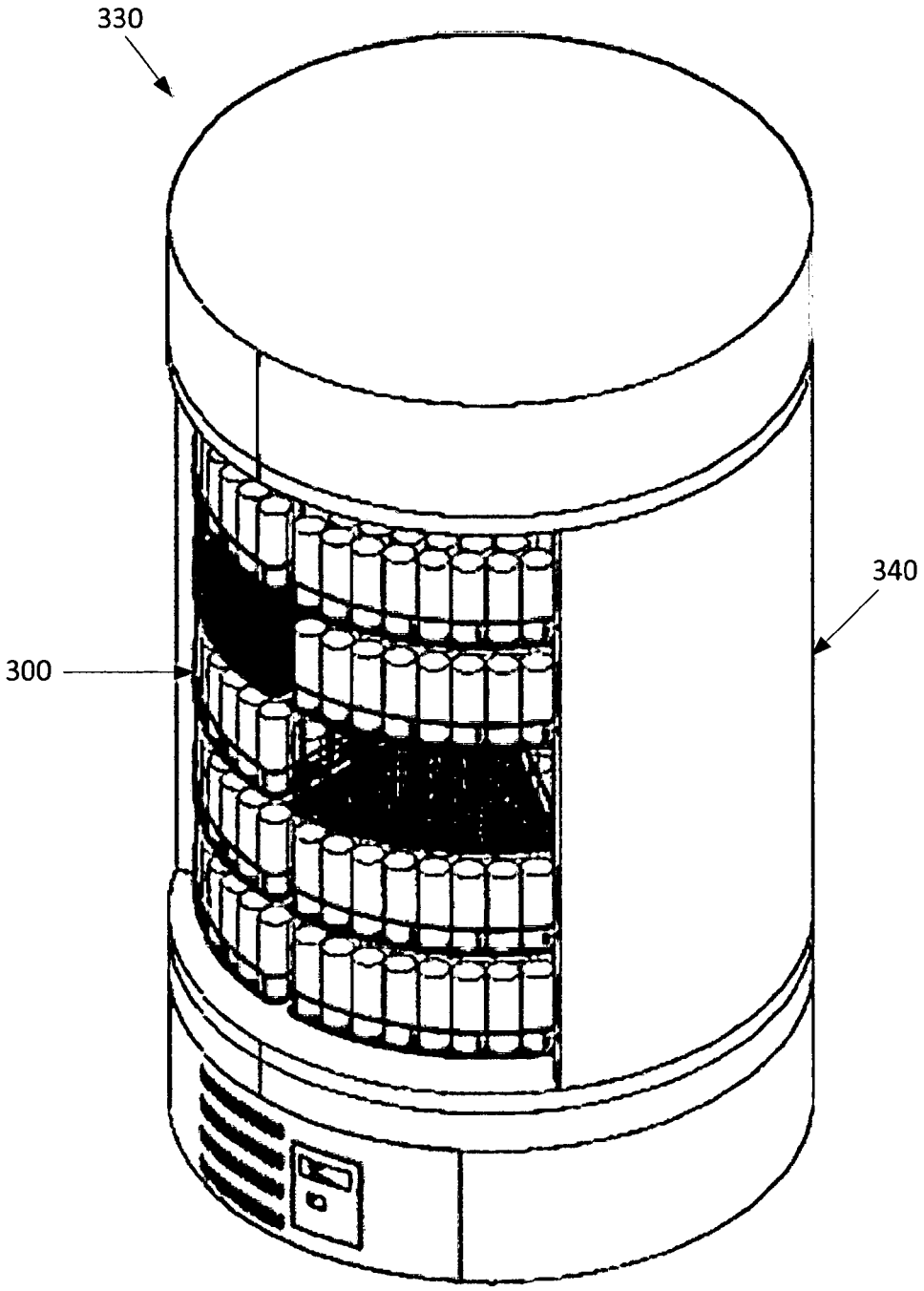
FIG. 10 is a perspective view of an alternative embodiment of an indexing cooler as may be described herein.
Figure 11:
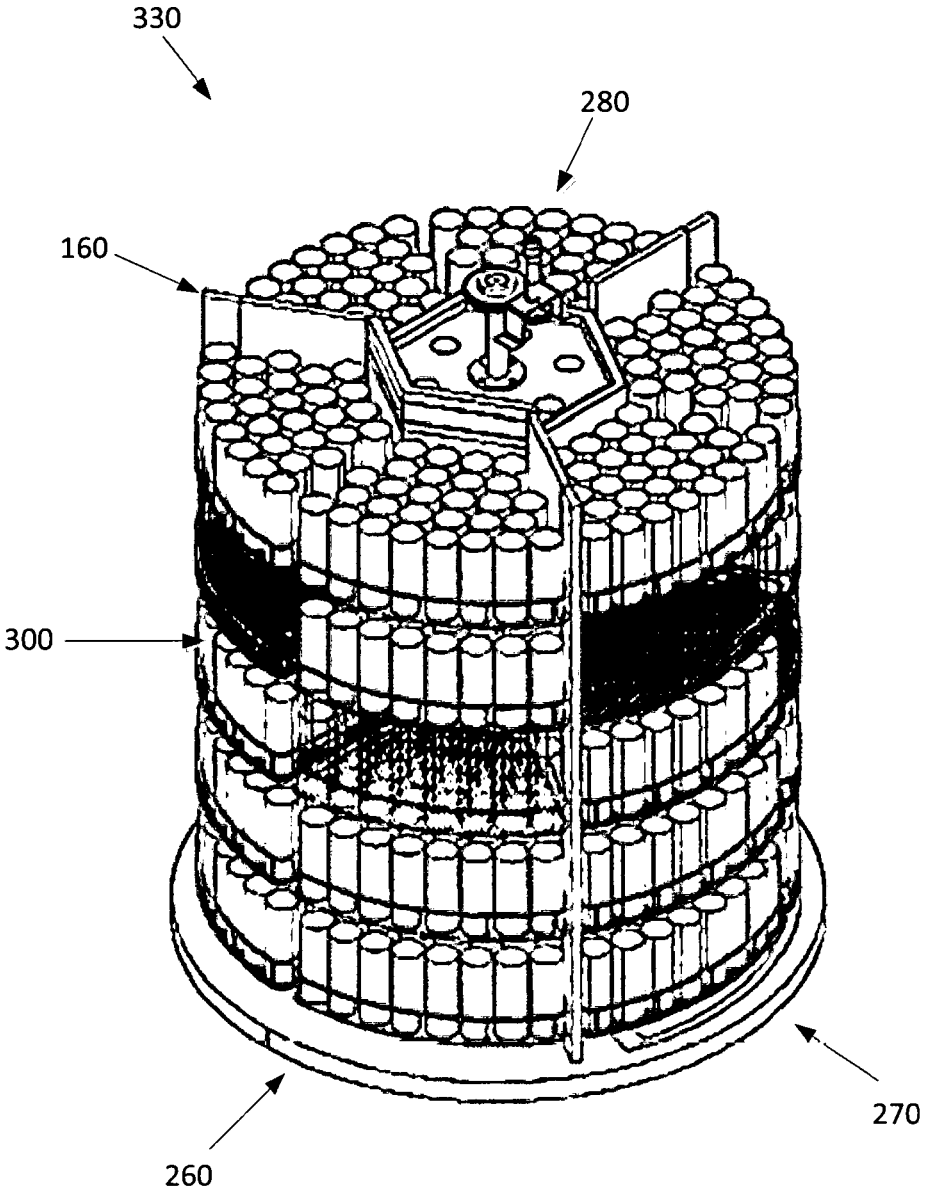
FIG. 11 is a perspective view of the indexing system of the indexing cooler of FIG. 10.

FIGS. 10 and 11 show a further embodiment of an indexing cooler 330 as may be described herein. In this example, the indexing cooler 330 may include an outer shell 120 with a substantially round configuration 340. Given such, the indexing cooler 330 also may use the indexing system 160 with the substantially round configuration 300 as is described above. Other components and other configurations also may be used herein.

Figure 12:
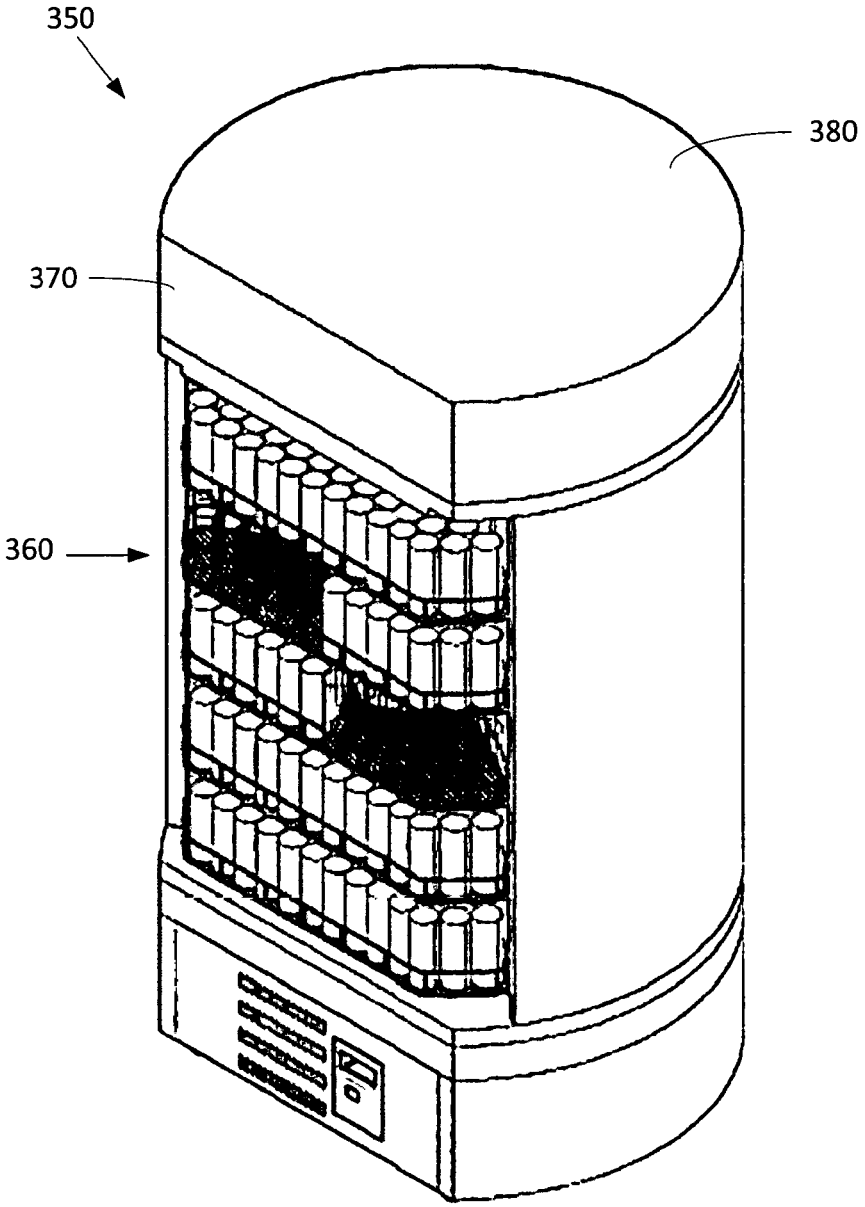
FIG. 12 is a perspective view of an alternative embodiment of the indexing cooler as may be described herein.
Figure 13:
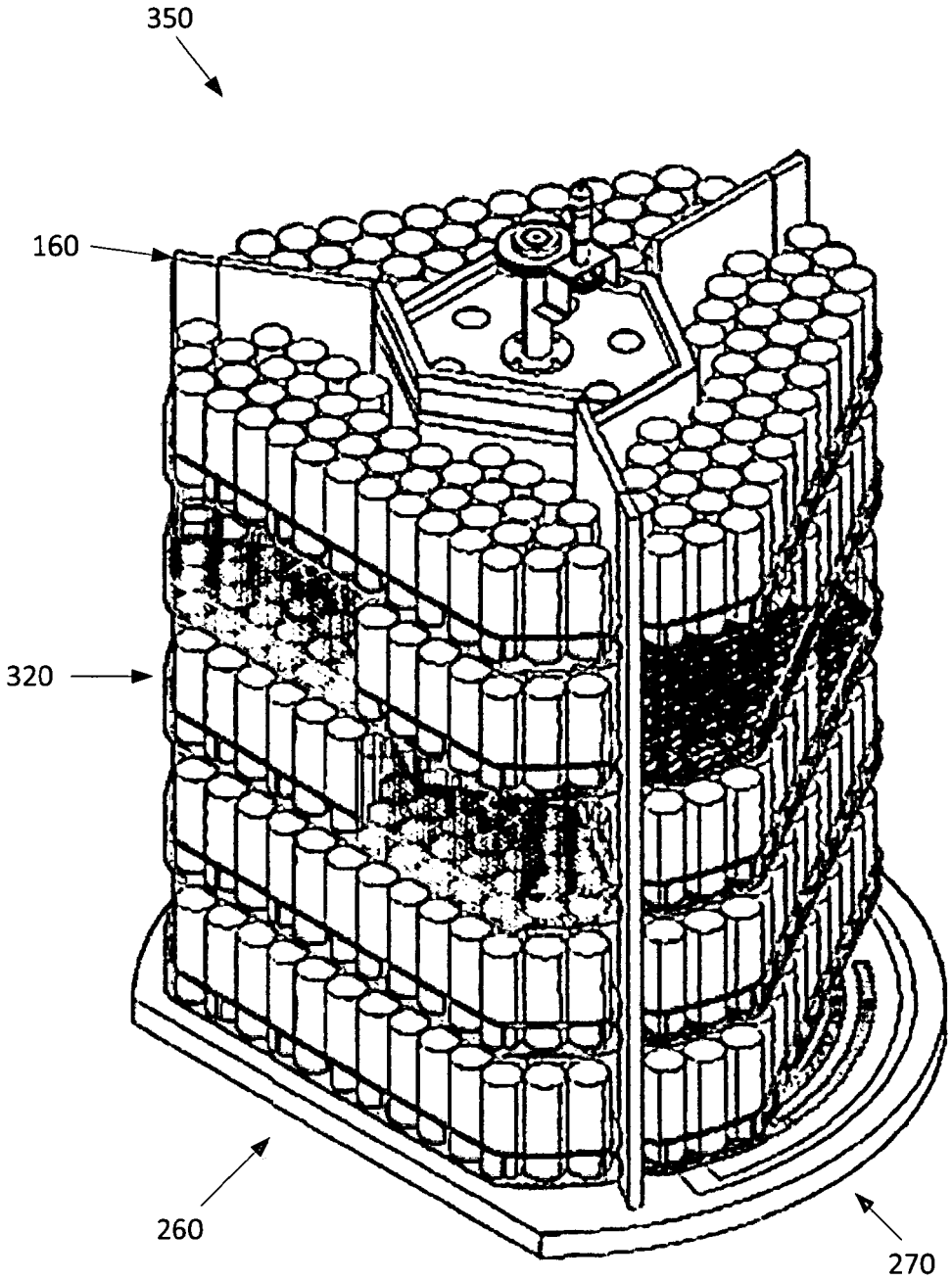
FIG. 13 is a perspective view of the indexing system of an indexing cooler of FIG. 12.

FIGS. 12 and 13 show a further embodiment of an indexing cooler 350 as may be described herein. In this example, the indexing cooler 350 may include an outer shell 120 with a semi-circular configuration 360. Specifically, the semi-circular configuration may have a flat side 370 about the open front 150 with the remainder having a circular side 380. The indexing cooler 350 may use the indexing system 160 with the flat configuration 320. Other components and other configurations may be used herein.

Figure 14:
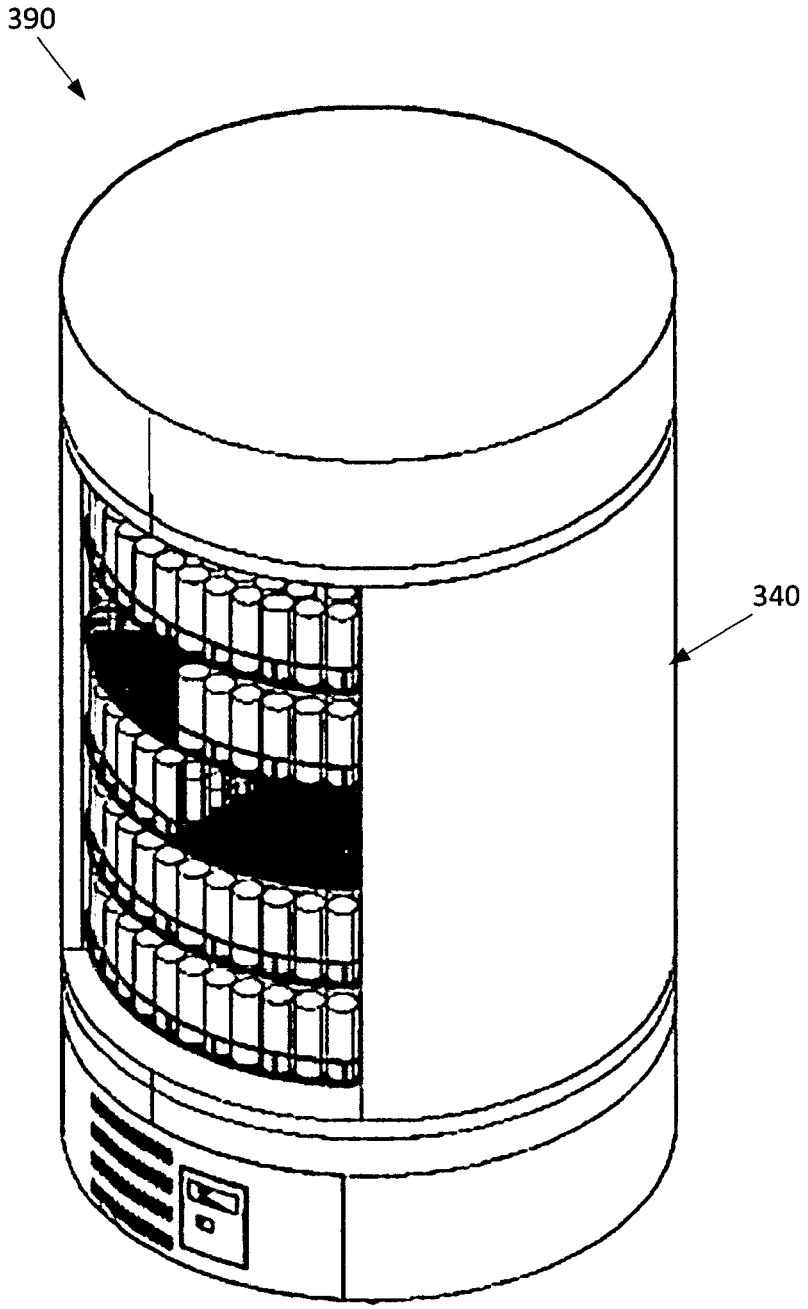
FIG. 14 is a perspective view of an alternative embodiment of the indexing cooler as may be described herein.
Figure 15:
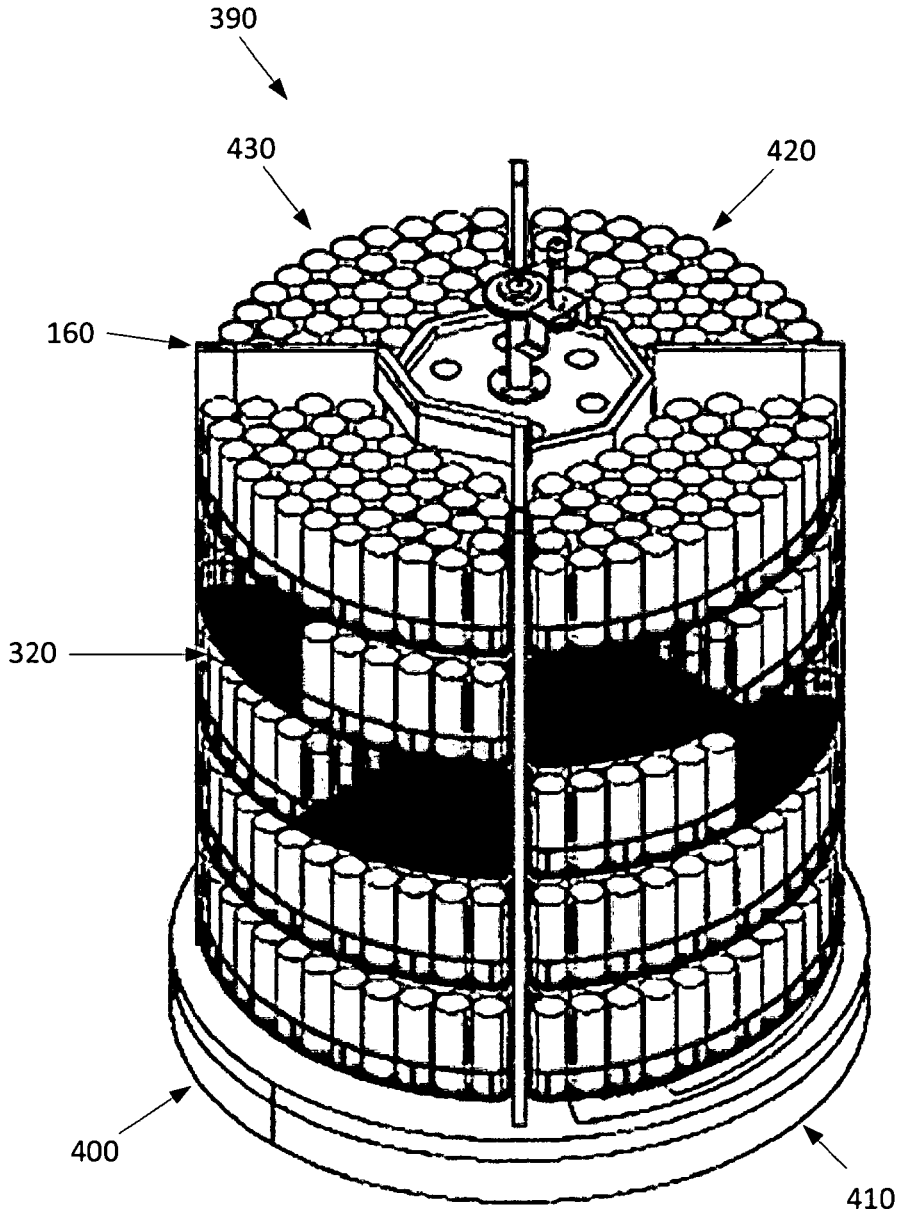
FIG. 15 is a perspective view of the indexing system of an indexing cooler of FIG. 14.

FIGS. 14 and 15 show a further embodiment of an indexing cooler 390 as may be described herein. In this example, the outer shell 120 may have the circular configuration 340. The indexing cooler 390 may have the indexing system 160 with four product zones 250 in the substantially round configuration 300. Specifically, a first product zone 400, a second product zone 410, a third product zone 420, and a fourth product zone 430. Any number of product zones 250 may be used herein. The ratio of ambient to refrigerated in this example may be about 1:3. Other ratios may be used herein. Other components and other configurations may be used herein.

Figure 16:
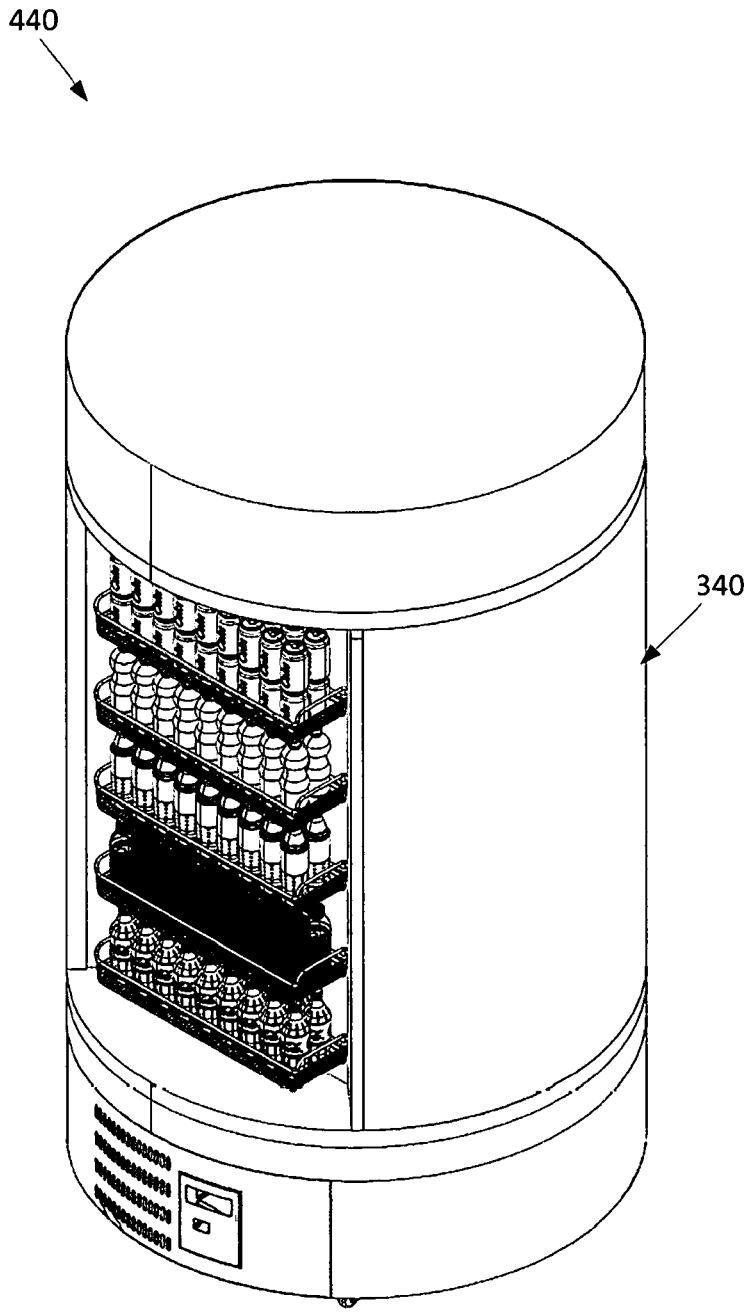
FIG. 16 is a perspective view of an alternative embodiment of the indexing cooler as may be described herein.
Figure 17:
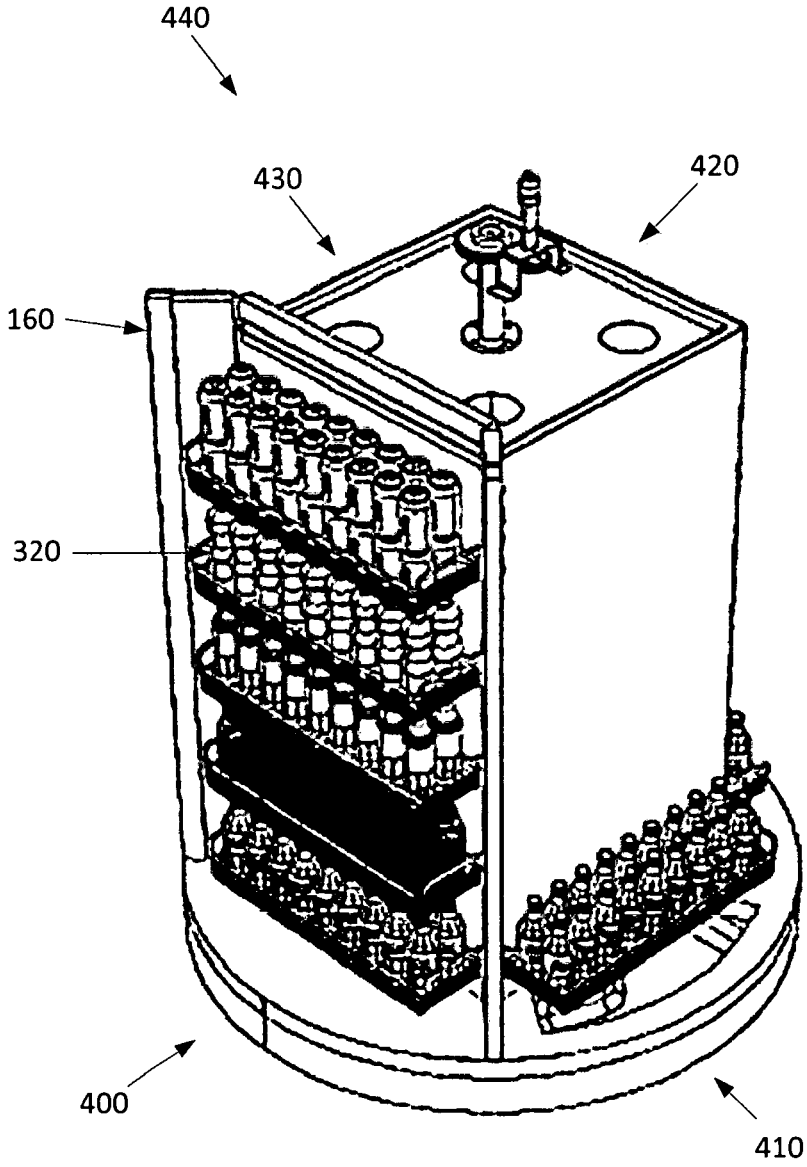
FIG. 17 is a perspective view of the indexing system of an indexing cooler of FIG. 16.

FIGS. 16 and 17 show a further embodiment of an indexing cooler 440 as may be described herein. In this example, the outer shell 120 may include the circular configuration 340. The indexing system 160 may include the flat configuration 320. Moreover, the indexing system 160 may include the four product zones 250. Other components and other configurations may be used herein.

Figure 18:
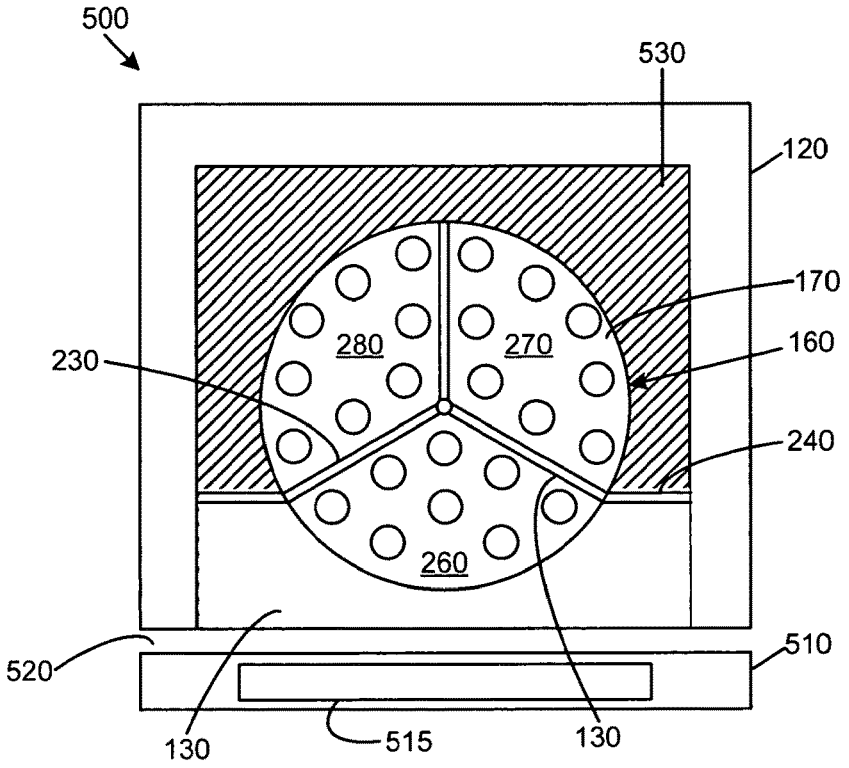
FIG. 18 is a perspective view of an alternative embodiment of a supercooling indexing cooler as may be described herein.

FIG. 18 shows an example of as supercooling indexing cooler 500 as may be described herein. The supercooling indexing cooler 500 may be somewhat similar to the indexing coolers described above. In this example, however, the outer shell 120 may include a glass door 510. The glass door 510 may have a transparent front panel 515 made from glass, thermoplastics, and like with good insulating properties. Multiple panels 515 may be used. The glass door 510 may seal the outer shell 120 via a gasket 520 and the like. The supercooling indexing cooler 500 may include conventional refrigeration equipment positioned at the top and/or the bottom of the outer shell 120 within the refrigeration component area 140.

The supercooling indexing cooler 500 may include the indexing system 160 within the product chamber 170. In this example, the three indexing wings 210, 220, and 230 are shown although any number of the indexing wings 200 may be used herein. The three indexing wings 210, 220, 230 may divide the product chamber 170 into the three product zones 260, 270, 280 although any number of the product zones 250 may be used herein. The indexing wings 210, 220, 230 may use the brush seals 240 and the like. As above, at any given time one of the product zones 250 will be in the exposed area 275 facing the glass door 510 and two of the product zones 250 will be sealed thereof in the refrigerated zones 265. Given the use of the three product zones 250, each product zone 250 will extend for about 120 degrees or about one-third of the total rotation. An amount of insulation 530 may be positioned between the product zones 250 and the outer shell 120.

Figure 19:
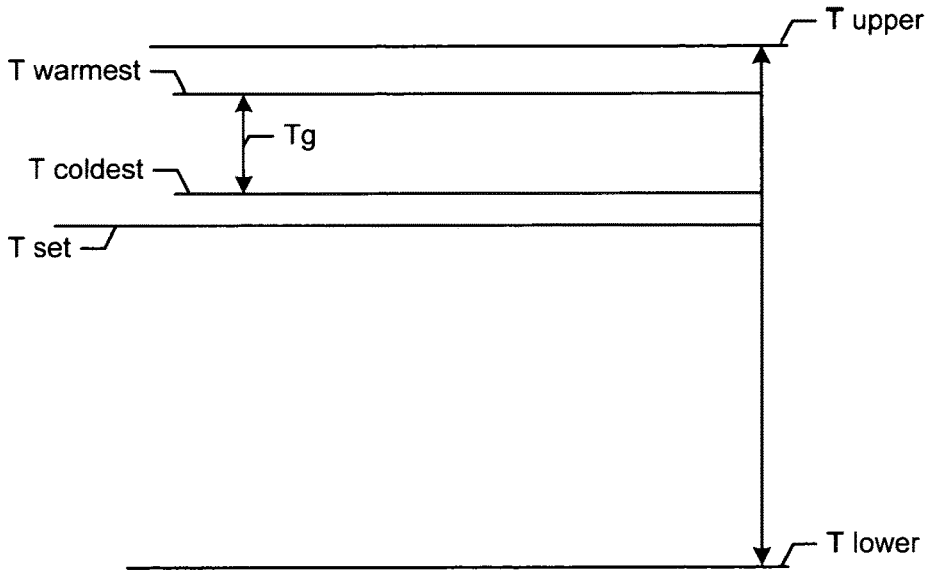
FIG. 19 is a cooling diagram for the supercooling indexing cooler of FIG. 18.

In order to avoid the thermal gradients Tg described above, either top to bottom or front to back, the indexing system 160 may be timed to rotate at a predetermined interval. Such timed rotation provides equal time for all products 110 to be exposed to the cold air in the refrigerated zone 265 and limits the time about the door 510 in the exposed zone 275. Moreover, consumers may see the different product zones 250 with a multitude of products 110 therein and a multitude of product choices. As is shown in FIG. 19, this equal time lowers the thermal gradients Tg therein such that a higher set point Tset may be used. The use of the higher set point Tset provides for an overall energy savings while the smaller thermal gradients Tg allows the supercooling indexing cooler 500 to supercool adequately all of the products 110 therein, i.e., the thermal gradients may be reduced to about two or three degrees Fahrenheit or so between, for example the bottom and the top of the cooler. Moreover, initial chill down also may be considerably faster.

The supercooling indexing cooler 500 also may accommodate different set points for different types of beverages. The volume and speed of the airflow may have an impact on the formation, or not, of thermal gradients therein.

The various configurations and combinations described herein for the indexing coolers are for the purpose of example only. Many different configurations and combinations of shapes and sizes may be used herein. The supercooling indexing cooler 500 provides supercooling ability with the indexing system 160 further attracting consumer interest, i.e., the motion of the indexing system 160 also serves to attract attention. Specifically, the use of the door 510, the insulation 530, and the predetermined rotation of the indexing system 160 to limit the time in the exposed zone 275 provides the reduced thermal gradients required for supercooling. The indexing system 160 also avoids "dead" spaces in the cooler such as against a back wall, a corner, the lights, and so forth where consumers may avoid selecting a product and hence may lead to waste. Rather, the indexing system 160 promotes easy access with equal product promotion therein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. An indexing cooler for a number of products, comprising:

an insulated outer shell;

a product chamber within the insulated outer shell;

a plurality of indexing wings each with an indexing wing brush seal thereon in contact with the product chamber;

an indexing drive motor for rotating the plurality of indexing wings; and the plurality of indexing wings defines a plurality of product zones;

wherein the indexing drive motor rotates one of the plurality of product zones into an unrefrigerated exposed zone for a predetermined length of time with all remaining plurality of product zones within a refrigerated zone defined and sealed by a pair of the indexing wing brush seals.

2. The indexing cooler of claim 1, wherein the indexing drive motor rotates each of the plurality of product zones into the refrigerated zone for a second predetermined length of time.

3. The indexing cooler of claim 1, wherein the outer shell comprises a substantially rectangular configuration.

4. The indexing cooler of claim 1, wherein the outer shell comprises a substantially circular configuration.

5. The indexing cooler of claim 1, wherein the plurality of product zones comprises a substantially circular configuration.

6. The indexing cooler of claim 1, wherein the plurality of product zones comprises a substantially flat configuration.

7. The indexing cooler of claim 1, wherein the plurality of product zones consists of three said product zones.

8. The indexing cooler of claim 1, wherein the plurality of product zones consists of four said product zones.

9. The indexing cooler of claim 1, wherein the product chamber is in communication with a refrigeration component area.

10. The indexing cooler of claim 9, wherein the product chamber is in communication with the refrigeration component area via a plurality of air vents and/or a return air plenum.

11. The indexing cooler of claim 1, wherein the plurality of indexing wings comprises a plurality of shelves.

12. The indexing cooler of claim 1, wherein the outer shell comprises an open front and wherein the open front is adjacent to the exposed zone.

13. The indexing cooler of claim 1, wherein the outer shell comprises a door and wherein the door is adjacent to the exposed zone.

* * * * *